United States Patent [19]

Johnson

[11] Patent Number: 5,042,204

[45] Date of Patent: Aug. 27, 1991

[54] FINISHING MACHINE FOR TROCHOIDAL SURFACES

[76] Inventor: James N. Johnson, P.O. Box 2747, Youngstown, Ohio 44507

[21] Appl. No.: 480,543

[22] Filed: Feb. 15, 1990

[51] Int. Cl.[5] ..... B24B 21/02; B24B 5/00

[52] U.S. Cl. ..... 51/145 R; 51/DIG. 32; 51/237 M; 51/73 R

[58] Field of Search ..... 51/257 M, 144, DIG. 32, 51/145 R, 73 R, 165.43, 90, 290, 281 P, 135 R, 89

[56] References Cited

U.S. PATENT DOCUMENTS

| | | | |
|---|---|---|---|
| 3,345,783 | 10/1967 | Militzer | 51/58 |
| 3,663,188 | 5/1972 | Hoglund . | |
| 3,693,297 | 9/1972 | Cann . | |
| 3,757,474 | 9/1973 | Pederson | 51/33 W |
| 3,805,454 | 4/1974 | Omonishi et al. . | |
| 3,812,574 | 5/1974 | Jones et al. . | |
| 3,861,275 | 1/1975 | Mueller | 51/DIG. 32 X |
| 3,921,339 | 11/1975 | Kikuchi . | |
| 3,943,665 | 3/1976 | Nagashima | 51/DIG. 32 X |
| 3,964,367 | 6/1976 | Stoferle et al. | 51/DIG. 32 X |
| 3,982,356 | 9/1976 | Dojyo et al. . | |
| 4,736,475 | 4/1988 | Ekhoff | 51/145 R X |

*Primary Examiner*—Frederick R. Schmidt
*Assistant Examiner*—Bruce P. Watson
*Attorney, Agent, or Firm*—Harpman & Harpman

[57] ABSTRACT

An improvement in a finishing machine for trochoidal surfaces of a rotary engine housing. The finishing machine rotates the engine housing in a trochoidal path around a constant tool engagement point that utilizes a super finishing abrasive film advancement oscillating head whereby precise finishing can be consistently obtained without abrasive tool wear and associated realignment of the abrasive tool.

5 Claims, 3 Drawing Sheets

FINISHING MACHINE FOR TROCHOIDAL SURFACES

BACKGROUND OF THE INVENTION

1. Technical Field

This invention relates to finishing machines used in finishing the inner trochoidal surface of a work piece, such as a rotary engine housing which requires uniform and precise finishing to achieve an effective seal between the trochoidal surface and the engine rotor which is well known and understood within the art.

2. Description of Prior Art

Prior Art devices of this type have used a variety of different designs to rotate either the housing about a fixed tool surface or guide the finishing tool around the trochoidal surface, see for example U.S. Pat. Nos. 3,812,574, 3,663,118, 3,693,297, 3,805,454, 3,921,339 and 3,982,356.

In U.S. Pat. No. 3,812,574 a finishing apparatus and process is disclosed that holds and rotates a work piece in a trochoidal path by securing the work piece to a holder having a cam surface that is driven by following drive wheel.

U.S. Pat. No. 3,663,188 is directed to a cam controlled grinding machine that has a driven cam engaged by rollers that are connected to a work piece support table. A fixed grinder tool engages the work piece as it and the table moves.

U.S. Pat. No. 3,693,297 discloses a fixed tool head and a cam driven work piece utilizing a pair of cams together to induce the required motion of the work piece in the trochoidal fashion.

In U.S. Pat. No. 3,805,454 a finishing machine is disclosed that moves a work piece in a trochoidal path by an offset gear drive shaft and a regulation assembly having a regulation shaft driven by the pinion offset gear.

U.S. Pat. No. 3,921,339 is directed to a trochoidal generating surface that uses a complex multi-shaft mechanism to impart trochoidal movement to a work piece mounting jig. The multiple shafts are engaged to one another by mesh gears and each is responsible for a particular point in the trochoidal path.

Finally in U.S. Pat. No. 3,982,356 a honing machine is disclosed that moves a tool in a trochoidal path to engage a fixed work piece.

SUMMARY OF THE INVENTION

A finishing machine for trochoidal surfaces that rotates a work piece around a oscillating finishing tool. The invention holds, rotates and advances the work piece against the finishing tool having a predetermined sequence to provide a high quality finish on the work piece's interior trochoidal surface. The finishing tool utilizes an abrasive film advancing over a work engagement platen of varying surface hardness. The trochodial path is generated by simple off center shaft and internalized rotating gearing.

DESCRIPTION OF THE PREFERRED EMBODIMENT

Figure 1:
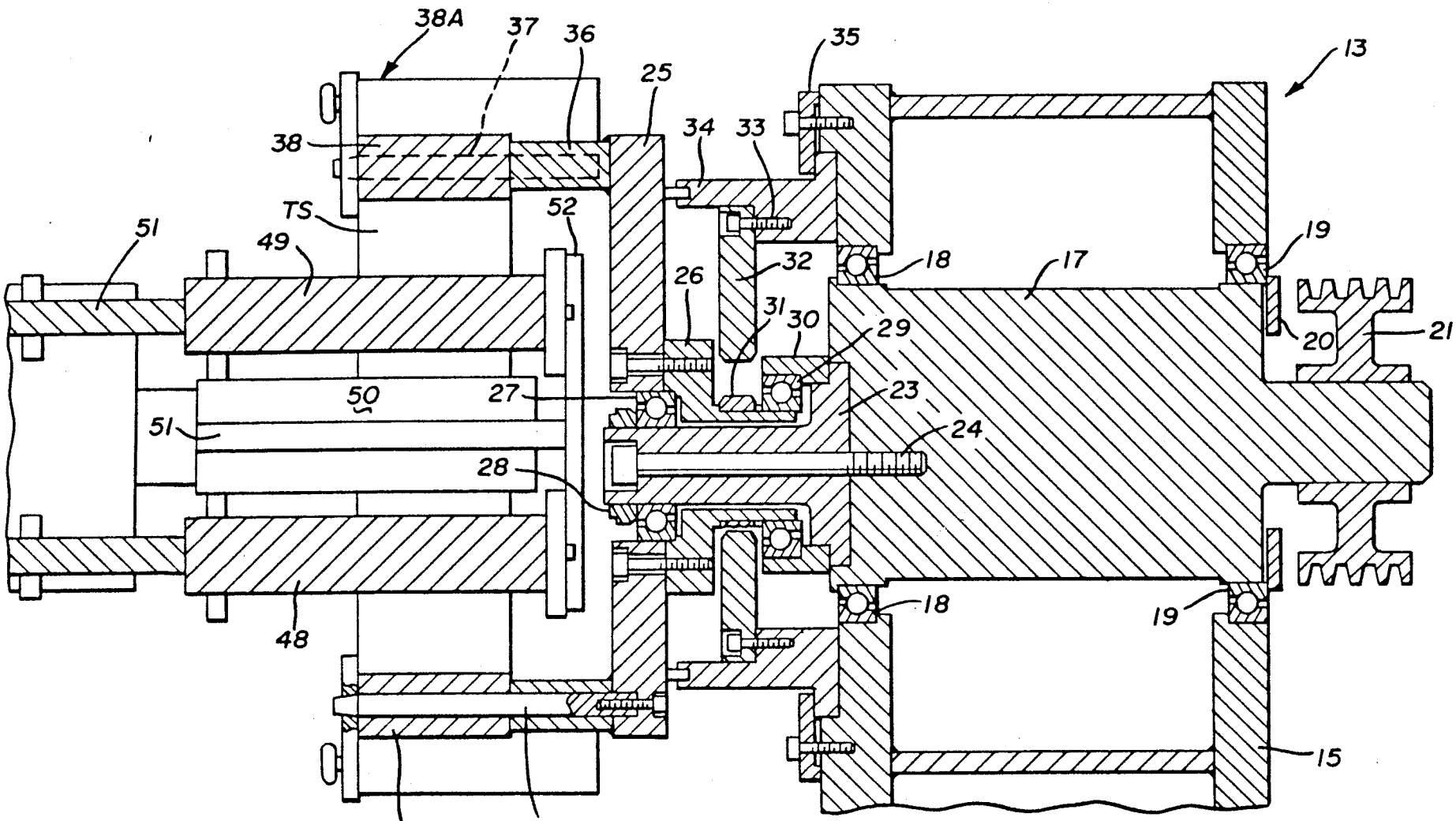
FIG. 1 is a partial cross-sectional view of the work piece holder and finishing tool within a work piece.
Figure 3:
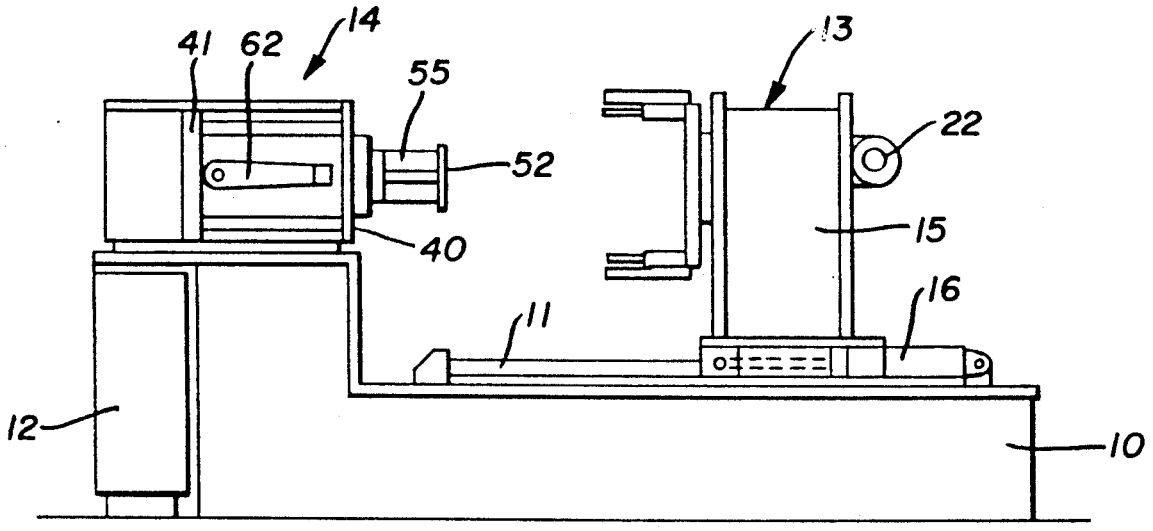
FIG. 3 is a side plan view of the finishing machine.
Figure 5:
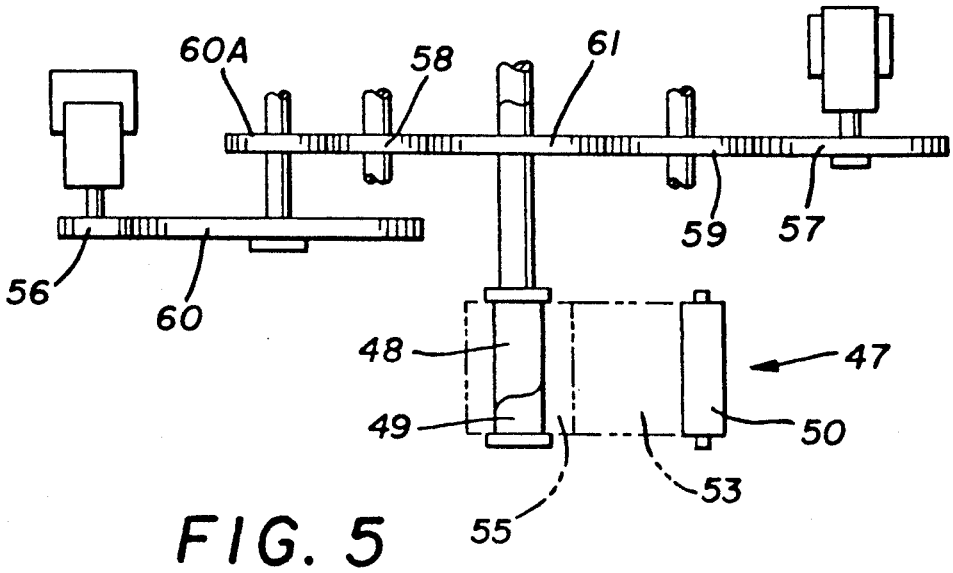
FIG. 5 is a schematic representation of the interconnected relationship of the selective drive gears for the finishing tool head.

A finishing machine can be seen in FIGS. 1, 3, and 5 of the drawings comprising a support base 10 having guide rods 11 and a control consul 12. The finishing machine has a work head 13 and a tool head 14 positioned respectively on said support base 10. The work head 13 is best seen in FIGS. 1 and 3 of the drawings comprising an upstanding support housing 15 movably secured to the guide rails 11. A hydraulic piston and cylinder assembly 16 is secured to the base 10 and the support housing 15 respectively for movement of same on the guide rails 11 as will be explained in greater detail later.

The work head 13 has a main drive shaft 17 positioned in the support housing 15 on a front main bearing 18 and a rear main bearing 19 by a rear main shaft bearing retainer 20. A drive pulley 21 is secured to one end of said main drive shaft 17 to except drive input from a drive motor 22. An offset drive shaft 23 is secured to the free end of the said main drive shaft 17 by a fastener 24. A face plate 25 is positioned around the offset shaft 23 by a face plate flange 26 having a front offset bearing 27 and front bearing retainer nut 28 and a rear offset bearing 29 and a rear bearing retainer 30.

A pinion gear 31 is secured to said face plate flange 26 in a fixed manner for meshed engagement with a ring gear 32 secured by fasteners 33 to a ring gear retainer 34 removably secured to the support housing 15 by a ring gear and clamp fastener assembly 35. The face plate 25 is of a generally rectangular configuration having oppositely disposed mounting extensions 36 thereon. Registration pins 37 extend outwardly from said mounting extensions 36 onto which a rotary engine housing 38 is engageable thereon. A clamping bracket and fastener assembly 38A is secured to and extends outwardly from said representative mounting extension 36 that will engage over said registration pins 37 and hold the engine housing 38 securely to the face plate 25. The engine housing 38 has an internal trochoidal surface TS typically found in rotary type engines.

It will be apparent from the above description that upon rotation of the main shaft 17 by the drive pulley 21 that the offset shaft 23 will follow an orbital path in relation to the center axis of the main shaft 17. The pinion gear 31 secured to the face plate flange 26 will be drawn around in mesh engagement with the fixed ring gear 31 imparting rotation to said face plate flange 26, the interconnected face plate 25 and secured engine housing 38. The inside pitch diameter of the ring gear 32 is concentric with the rotational axis of the main shaft 17. The internal pitch diameter of said pinion gear 31 is 1.5 times the pitch diameter of said ring gear regardless of the engine housing 38 respective size. The combination of the orbital path of the offset shaft 23 and the face plate 25 rotation about the offset shaft 23 imparts a trochoidal movement to the engine housing 38 secured to the mounting extension 36 that will correspond to and follow the inner trochoidal surface TS of the engine housing 38.

Referring now to FIGS. 1,3,4, and 6 of the drawings, the tool head 14 can be seen having a support frame assembly 37A secured to the support base 10. The support frame assembly 37A is comprised of pairs of oppositely disposed, vertically spaced and aligned guide bars 39 supported between a front support housing 40 and a rear support housing 41. A tool support and drive assembly 42 is movably secured on a pair of spaced vertically aligned secondary guide bars 43 that are carried respectively from journaled guide followers 44 positioned on said guide bar pairs 39 respectively. The tool support and dirve assembly 42 is comprised of a primary housing 45 having guide support sleeves 46 extending therefrom and movably secured to said respective secondary guide bars 43, best seen in FIGS. 4 and 6 of the drawings.

A finishing tool head 47 extends from said housing 45 and is comprised of a pair of vertically aligned and spaced dispensing and retrieval rollers 48 and 49 and a work piece engagement free wheeling platen 50. The rollers and platen 48–50 respectively are held by support assembly elements 51 and a front cover plate 52 that is removably secured thereto for access to said respective rollers for positioning of micro-abrasive film 53 on supply and take-up drums 54 and 55.

Figure 4:
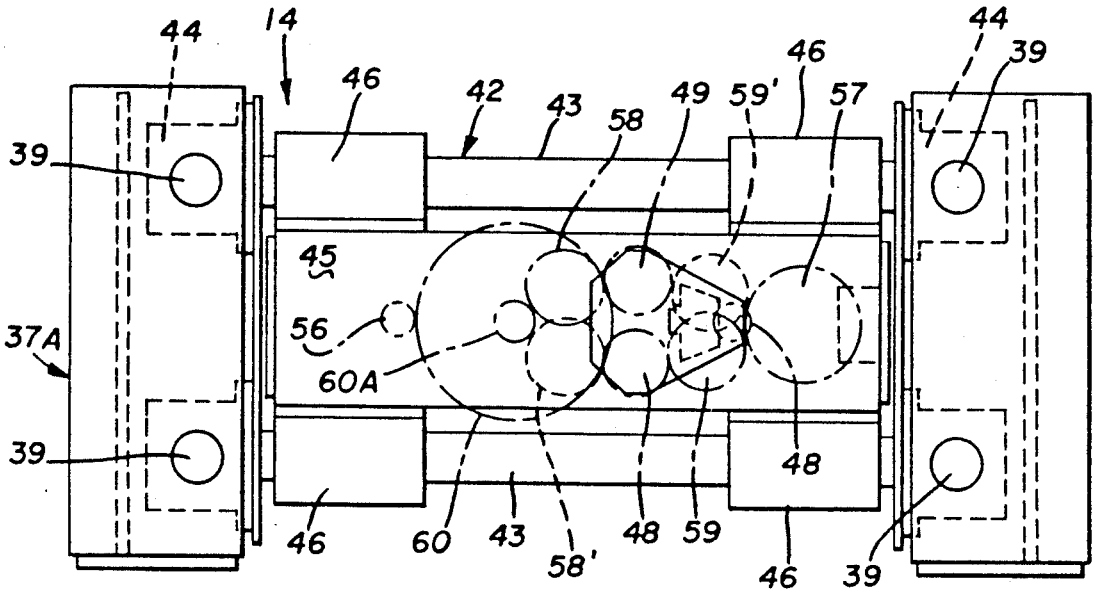
FIG. 4 is a front plan view of a portion of the finishing machine.

Referring now to FIGS. 4 and 5 of the drawings a gear drive assembly for said finishing tool head 47 can be seen having a drive motor and gear 56, a pneumatically powered slip clutch and gear assembly 57, a pair of interchangeable idler gears 58 and 59 and reduction gears 60 and 60A associated therewith.

FIG. 5 schematically illustrates the gear drive assembly wherein the rollers 48 and 49 can be selectively engaged through a shaft gears 61 by either the drive motor 56 via movable idler gear 58 or the clutch and gear assembly 57 via the movable idler gear 59 as seen in dotted and broken lines respectively in FIG. 4 of the drawings.

It will be apparent that as the micro-abrasive film 53 is retrieved by the take-up drum 55 on the retrieval roller 49 under engagement drive by idler gear 58, it is dispensed from supply drum 54 on dispensing roller 48 restricted in free rotation by the clutch gear assembly 57 via idler gear 59. The abrasive film 53 extends over the work piece engagement platen 50 exposing an ever renewing abrasive film portion against the work piece (trochoidal surface TS of the engine housing 38).

Figure 6:
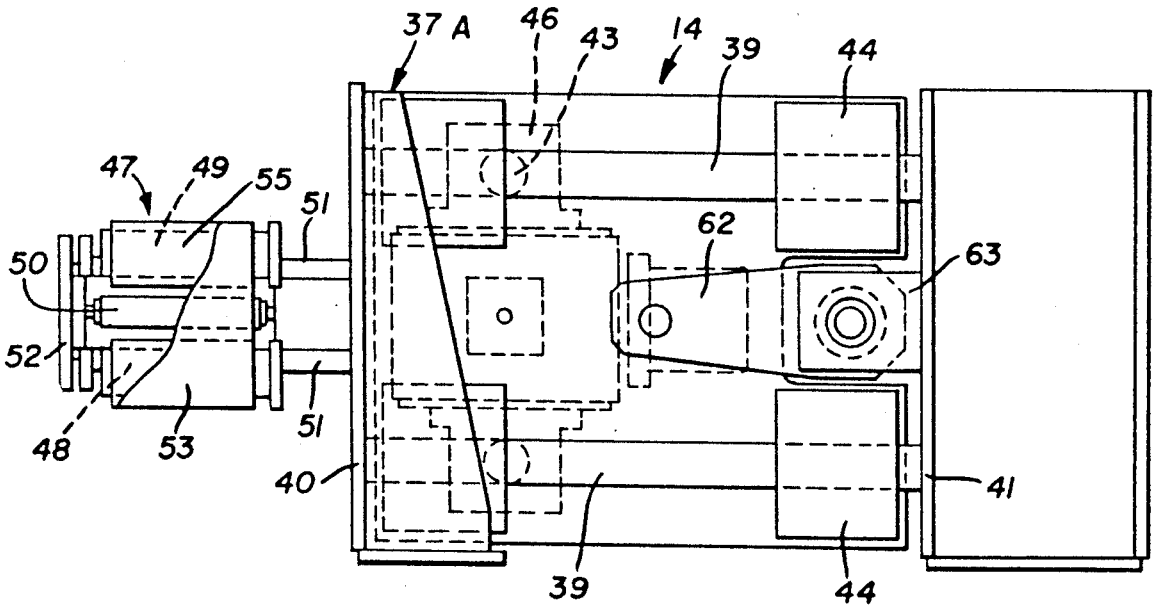
FIG. 6 is a top plan view of a portion of the finishing tool.

The finishing tool head 47 oscillates on a horizontal axis as seen in FIG. 6 of the drawings by engagement with a crank cam and rod assembly 62 driven by a motor 63 as will be well understood by those skilled in the art.

In operation, the engine housing 38 is secured to the extensions 36 of the face plate as hereinbefore described. The work head 13 advances towards the tool head 14 on the guide bars 11 by activation of the piston and cylinder assembly 16. The platen 50 of the oscillating finishing tool head 47 is engaged against the trochoidal surface TS of the engine housing 38 as seen in FIGS. 1 and 2 of the drawings.

Figure 2:
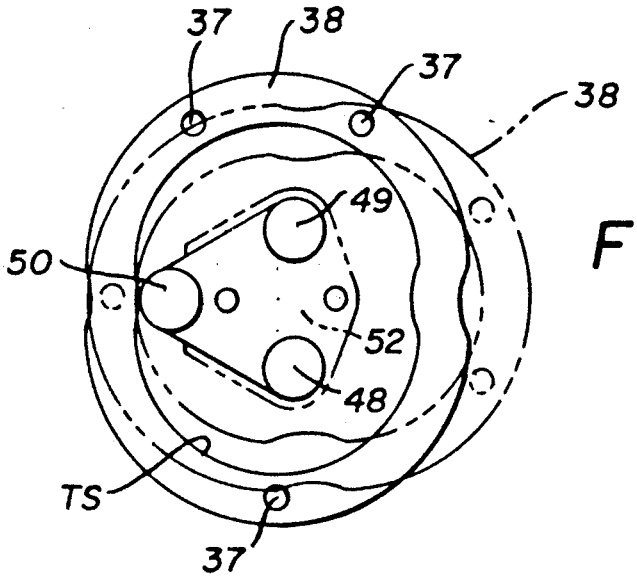
FIG. 2 is a schematic view of the finishing tool engaging the work piece as it representatively moves about the work tool.

Once the engine housing 38 is positioned as described above, the face plate 25 is rotated imparting a relative trochoidal path to the engine housing 38 as seen in FIG. 2 in solid and broken lines about the finishing tool head 47 which maintains a relative fixed position oscillating on its horizontal axis as hereinbefore described finishing the inner trochoidal surface TS of the engine housing 38 with the abrasive film 53.

It will be evident from the above description that the direction of the abrasive film 53 can be reversed by moving the representative idler gears 58 and 59 to positions indicated in FIG. 4 of the drawings in dotted lines 58' and 57' respectively. The platen 50 can be of varied degrees of hardness to impart different qualities to the selective abrasive film used. An example of such action would be the hardest platen used to flatten the work piece surface during the initial finishing with the graduation by abrasive grit and platen hardness to the softest platen following the finishing contour of the trochoidal surface TS making the selective abrasive act as a buffing media.

It will also be apparent that the oscillation of the finished tool head 47 on its horizontal axis via the crank rod and cam assembly 62 as the abrasive film 53 is slowly advanced will impart a highly desirable finished surface to the trochoidal surface TS of the engine housing 38 by variation of scratch patterns thereon which will be understood by those skilled in the super finishing art.

Thus it will be seen that a new and useful finishing machine for trochoidal surfaces has been illustrated and described and various combinations and changes may be made therein without departing from the spirit of the invention, therefore I claim:

1. An apparatus for finishing non-circular work pieces of a trochoidal configuration comprising in combination, a movable work head and a axially positioned tool head on a support base, said work head movable towards and away from said tool head on guide rods positioned on said support base, said work head having holding means to grip a work piece having an inner trochoidal surface and rotating same in a trochoidal path of that defined by the work piece about the tool head, said work head having a main drive shaft, a support housing securing said shaft, an offset shaft extending from said main drive shaft, gear means secured to said holding means for meshed engagement with a secondary gear means affixed to said support housing, means for driving and controlling said main drive shaft and said work piece on said support base and in relation to said tool head, a support frame assembly on said support base, a first pair of vertically spaced and aligned guide bars in said support frame assembly, a secondary pair of vertically spaced aligned guide bars movably positioned on said first pair of said guide bars, a tool support and drive assembly movably secured on said secondary pair of vertically spaced aligned guide bars, a finishing tool head extending from said support and drive assembl,' comprising a pair of spaced vertically aligned rollers and a work piece engaging platen, said rollers adapted to receive abrasive film dispensing and retrieving drums, micro-abrasive film on said drums engaging said platen, said support and drive assembly further comprising removable positionable idler gears and shaft gears for selectively driving said rollers, and means for oscillating said support and drive assembly on said first spaced vertically aligned guide bars in a fixed longitudinal axis.

2. The apparatus of claim 1 wherein said gear means comprises a pinion gear secured to a face plate flange rotatable about said offset shaft, and said secondary gear means comprising a ring gear secured to said support housing.

3. The apparatus of claim 1 wherein said holding means comprises a face plate having mounting extensions with registration pins registrable with said work piece, a clampling bracket engages over said registration pins extend through the work piece.

4. The apparatus of claim 1 wherein said means for driving and controlling said main drive shaft comprises a drive pulley and interconnected drive motor.

5. The apparatus of claim 1 wherein said means for oscillating said support drive assembly on said first pair of vertically spaced aligned guide bars comprises a crank rod and cam assebly.

* * * * *